US008245782B2

(12) United States Patent
Sanchez

(10) Patent No.: US 8,245,782 B2
(45) Date of Patent: Aug. 21, 2012

(54) TOOL AND METHOD OF PERFORMING RIGLESS SAND CONTROL IN MULTIPLE ZONES

(75) Inventor: Mariano Sanchez, Jakarta Selatan (ID)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/620,681

(22) Filed: Jan. 7, 2007

(65) Prior Publication Data

US 2008/0164027 A1 Jul. 10, 2008

(51) Int. Cl.
*E21B 43/04* (2006.01)

(52) U.S. Cl. ..... 166/278; 166/51; 166/386

(58) Field of Classification Search ..... 166/278, 166/298, 297, 51, 306, 386, 387, 205
See application file for complete search history.

(56) References Cited

U.S. PATENT DOCUMENTS

| | | | | |
|---|---|---|---|---|
| 2,340,481 | A | 2/1944 | Lloyd | |
| RE24,617 | E | 3/1959 | Greene | |
| 3,439,740 | A | 4/1969 | Conover | |
| 4,428,431 | A * | 1/1984 | Landry et al. | 166/298 |
| 4,519,451 | A | 5/1985 | Gray et al. | |
| 4,566,538 | A * | 1/1986 | Peterson | 166/278 |
| 5,174,379 | A | 12/1992 | Whiteley et al. | |
| 5,377,750 | A | 1/1995 | Arterbury et al. | |
| 5,609,204 | A | 3/1997 | Rebardi et al. | |
| 5,636,691 | A | 6/1997 | Hendrickson et al. | |
| 5,875,852 | A | 3/1999 | Floyd et al. | |
| 5,921,318 | A | 7/1999 | Ross | |
| 5,988,285 | A | 11/1999 | Tucker et al. | |
| 6,059,032 | A | 5/2000 | Jones | |
| 6,059,033 | A * | 5/2000 | Ross et al. | 166/278 |
| 6,148,915 | A | 11/2000 | Mullen et al. | |
| 6,216,785 | B1 | 4/2001 | Achee, Jr. et al. | |
| 6,220,353 | B1 | 4/2001 | Foster et al. | |
| 6,230,801 | B1 | 5/2001 | Hill, Jr. et al. | |
| 6,302,216 | B1 * | 10/2001 | Patel | 166/375 |
| 6,343,651 | B1 | 2/2002 | Bixenman | |
| 6,371,210 | B1 | 4/2002 | Bode et al. | |

(Continued)

FOREIGN PATENT DOCUMENTS

EP 0430389 B1 7/1994

(Continued)

OTHER PUBLICATIONS

Syed Ali, David Norman, David Wagner, Joseph Ayoub, Jean Desroches, Hugo Morales, Paul Price, Don Shepherd, Ezio Toffanin, Juan Troncoso, Shelby White "Combined Stimulation and Sand Control" Oilfield Rreview Summer 2002 pp. 30-47 www.slb.com/media/services/resources/oilfieldreview/ors02/sum02/p30_47.pdf.*

(Continued)

*Primary Examiner* — Cathleen Hutchins
(74) *Attorney, Agent, or Firm* — David G. Matthews; Rodney Warfford

(57) ABSTRACT

A rigless sand-control tool string is for use in a wellbore having plural zones. The tool string includes plural flow port assemblies, and plural screen assemblies connected to corresponding circulation port assemblies. Each set of one of the flow port assemblies and one of the screen assemblies is configured to perform sand control with respect to a corresponding zone of the wellbore. The flow port assemblies are selectively activatable to allow selective performance of sand control with respect to the corresponding zones.

18 Claims, 3 Drawing Sheets

U.S. PATENT DOCUMENTS 6,446,729 B1 9/2002 Bixenman et al.
6,464,006 B2 10/2002 Womble
6,488,082 B2 12/2002 Echols et al.
6,568,474 B2 5/2003 George
6,575,246 B2 6/2003 Bixenman et al.
6,622,794 B2 9/2003 Zisk, Jr.
6,702,020 B2 3/2004 Zachman et al.
6,719,064 B2 4/2004 Price-Smith et al.
6,729,407 B2 5/2004 Stoesz
6,745,834 B2 6/2004 Davis et al.
6,749,023 B2 6/2004 Nguyen et al.
6,766,857 B2 7/2004 Bixenman et al.
6,766,862 B2 * 7/2004 Chatterji et al. ..... 166/381
6,782,948 B2 8/2004 Echols et al.
6,786,285 B2 9/2004 Johnson et al.
6,886,634 B2 5/2005 Richards
6,899,176 B2 5/2005 Hailey, Jr. et al.
6,907,936 B2 6/2005 Fehr et al.
6,978,840 B2 12/2005 Henderson
6,983,796 B2 1/2006 Bayne et al.
6,988,547 B2 1/2006 Goodwin et al.
7,017,664 B2 3/2006 Walker et al.
7,021,384 B2 4/2006 Themig
7,055,598 B2 6/2006 Ross et al.
7,100,690 B2 9/2006 Mullen et al.
7,124,824 B2 10/2006 Turner et al.
7,128,151 B2 10/2006 Corbett
7,152,678 B2 12/2006 Turner
7,210,527 B2 5/2007 Walker et al.
7,237,616 B2 7/2007 Patel
7,252,152 B2 8/2007 LoGiudice et al.
7,331,388 B2 2/2008 Vilela et al.
7,367,395 B2 5/2008 Vidrine et al.
7,383,884 B1 6/2008 Turner et al.
7,472,750 B2 1/2009 Walker et al.
7,523,787 B2 4/2009 Richards et al.
7,712,524 B2 5/2010 Patel et al.
7,918,276 B2 4/2011 Guignard et al.
2002/0007949 A1 1/2002 Tolman et al.
2002/0036087 A1 3/2002 Bixenman et al.
2002/0062960 A1 * 5/2002 George et al. ..... 166/278
2002/0070019 A1 6/2002 Dusterhoft et al.
2003/0047311 A1 3/2003 Echols
2003/0070809 A1 * 4/2003 Schultz et al. ..... 166/278
2003/0188871 A1 10/2003 Dusterhoft et al.
2004/0094304 A1 5/2004 Turner et al.
2004/0118564 A1 6/2004 Themig et al.
2004/0129419 A1 7/2004 Van Wulfften
2004/0134656 A1 7/2004 Richards
2004/0251024 A1 12/2004 Jones
2005/0178552 A1 8/2005 Fehr et al.
2006/0042795 A1 3/2006 Richards
2006/0090900 A1 5/2006 Mullen et al.
2006/0113089 A1 6/2006 Henriksen et al.
2006/0124310 A1 * 6/2006 Lopez de Cardenas et al. ..... 166/313
2006/0124311 A1 6/2006 Lopez de Cardenas et al.
2006/0124312 A1 6/2006 Rytlewski et al.
2006/0196660 A1 9/2006 Patel
2008/0128130 A1 6/2008 Whitsitt et al.
2008/0142225 A1 6/2008 Prado et al.
2009/0025923 A1 1/2009 Patel et al.
2009/0145603 A1 6/2009 Coronado
2010/0163235 A1 7/2010 Mootoo et al.

FOREIGN PATENT DOCUMENTS

GB 2083854 3/1982
WO 0005484 A1 2/2000
WO 0165063 A1 9/2001
WO 03023185 A1 3/2003

OTHER PUBLICATIONS

Schlumberger Ltd., Oilfield Glossary, "Rig", 2006.

Schlumberger Ltd., Oilfield Glossary, "Rigless Operation", 2006.

UK Intellectual Property Office Examination Report for U.K. Appln. No. GB 0721646.8 dated Feb. 29, 2008 (7 pages).

UK Intellectual Property Office Examination Report for U.K. Appln. No. GB 0721646.8 dated Mar. 27, 2009 (2 pages).

Integrated Perforating and Gravel Packing Speeds Completions, Case Study: PERFPAC Service Reduces Formation Damage, Saves Rig Time in West African Deepwater Play. 06-WT-084, Aug. 2006.

PERFPAC Image.

Quantum PERFPAC Single-Trip System; SC_03_044_0, Jan. 2004.

Schlumberger PERFPAC webpage.

International Search Report for PCT Application No. PCT/US2008/050215.

International Search Report for PCT Application No. PCT/US2007/086507.

International Search Report for PCT Application No. PCT/US2009/067314.

* cited by examiner

TOOL AND METHOD OF PERFORMING RIGLESS SAND CONTROL IN MULTIPLE ZONES

TECHNICAL FIELD

The invention relates generally to sand control in multiple zones.

BACKGROUND

As part of completing a well, sand control is performed to prevent or reduce the amount of sand that is produced with hydrocarbons into a wellbore. Sand production can erode hardware, block tubular structures installed in a wellbore, create downhole cavities, and cause other problems. Sand control can be performed in both open holes (wellbores that are not lined with a casing or liner) and in cased or lined wellbores. One type of sand control technique that is used involves gravel packing, in which a slurry containing gravel is carried from the surface and deposited in an annulus between a sand-control screen and the wellbore.

However, conventional gravel-packing techniques have not been efficiently used in multi-zone arrangements (in which a wellbore is segmented into different zones with each zone having to be separately gravel-packed). Often, gravel packing equipment has to be moved between gravel packing operations with respect to different zones, which is time-consuming.

SUMMARY

In general, according to an embodiment, a sand-control tool string is for use in a wellbore having plural zones. The sand-control tool string has plural flow port assemblies and plural screen assemblies connected to corresponding flow port assembles, where each set of one of the flow port assemblies and one of the screen assemblies is deployable to perform a sand-control operation with respect to a corresponding zone of the wellbore. The flow port assembles are selectively activatable to allow selective performance of sand-control operations with respect to corresponding zones.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In accordance with some embodiments, a sand-control tool string can be used for performing selective sand-control operations with respect to multiple zones in a wellbore. The multiple zones of a wellbore refer to different segments of the wellbore, where the different segments can be isolated from each other, such as by packers or other sealing elements. Production of hydrocarbons can be performed from each of the zones. The sand-control tool string allows for selective sand-control operation in each zone by providing an operator with the ability to selectively control flow ports in different parts of the tool string that correspond to the different zones. Sand-control operations can be performed with respect to the different zones without having to move the sand-control tool string between the different zones.

Although reference is made to producing hydrocarbons, it is noted that the sand-control tool string can be used in other types of wells, such as wells for producing fresh water.

In some embodiments, a sand-control operation includes a gravel-pack operation in which a gravel slurry is pumped down a tubing string to the sand-control tool string for communication through a selectively opened set of ports to a well annulus region between the tool string and the wellbore. Gravel slurry typically includes carrier fluid containing gravel particles that are used to filter out particulates such that sand or other small particulates do not enter the tubing string. Sand-control tool strings in accordance with some embodiments can be used in either an open wellbore (that is not cased or lined) or in a cased wellbore (that is lined with casing or a liner).

A benefit of the sand-control tool string, according to some embodiments, is that after placing the sand control assembly on depth, the sand-control operations can be performed without a workover rig. Thus, the components of the sand-control tool string can be manipulated riglessly (without presence of a rig). A rigless deployment saves the expense of having to set up the rig. Typically, a rig includes a drillstring and other components.

Figure 1:
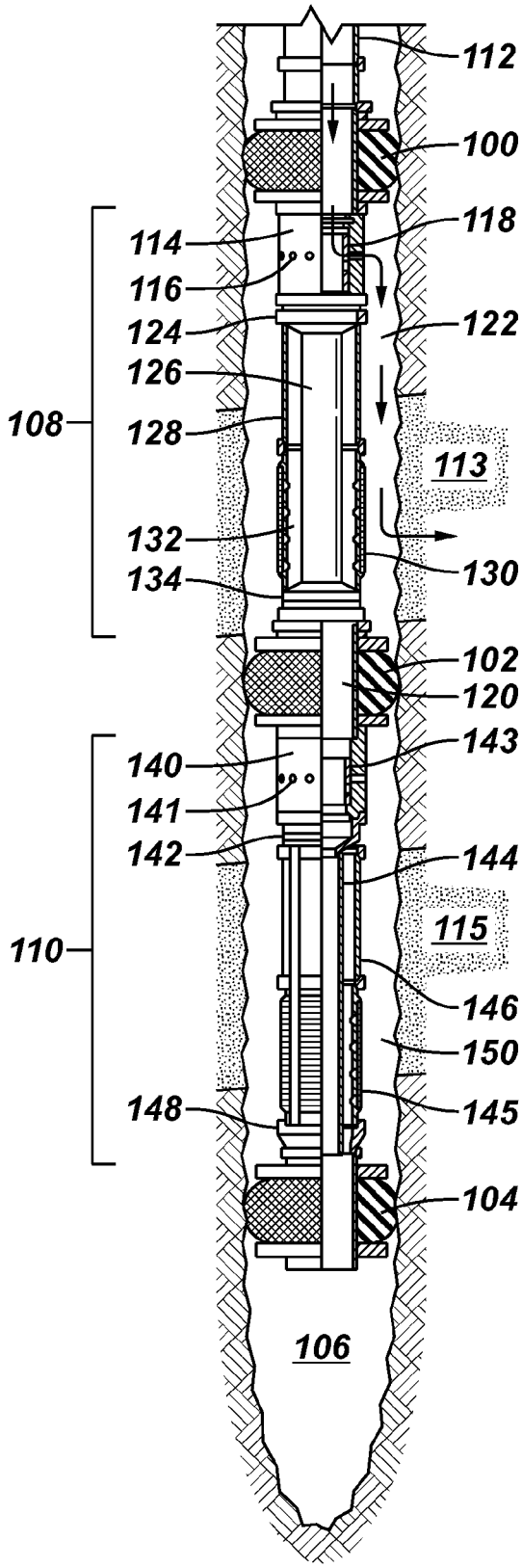
FIG. 1 illustrates a sand-control tool string for use in an open wellbore, according to an embodiment.

FIG. 1 illustrates a sand-control tool string according to an embodiment for use in an open wellbore 106. The open wellbore 106 is not lined with casing or a liner. The sand-control tool string of FIG. 1 includes several packers 100, 102, and 104, which are set to define different zones in a wellbore 106. Each of the packers 100, 102, and 104 has sealing elements that, when actuated, seal against the surface of the wellbore 106 such that a first (upper) zone 108 and second (lower) zone 110 are defined. The upper zone 108 is between packers 100 and 102, and the lower zone 110 is between packers 102 and 104. Each of the zones 108 and 110 is adjacent respective formations 113, 114, which may contain hydrocarbons.

Note that the packer 100 also isolates the region of the wellbore 106 above the packer from the upper zone 108, and the packer 104 isolates the region of the wellbore 106 below the packer 104 from the lower zone 110. The sand-control tool string is attached to a tubing string 112 to allow communication of materials (such as gravel-pack slurry) through the tubing string 112 from the earth surface to the sand-control tool string.

Connected below the packer 100 is a circulation port assembly 114 having a plurality of circulation ports 116. More generally, the circulation port assembly 114 is substituted with a flow port assembly having one or more flow ports. The circulation port assembly 114 includes a sliding sleeve 118 (or other type of valves) that is operable between different positions to allow or block communication through circulation ports 116 between an inner bore 120 of the tool string and a well annulus region 122 in the upper zone 108.

An upper three-way sub 124 connects an isolation tubing 126 to the circulation port assembly 114. The upper three-way sub 124 also connects the circulation port assembly 114 to a screen assembly 128, which has a screen 130. The screen assembly 128 is provided concentrically around the isolation tubing 126 such that an annulus region 132 is provided between the isolation tubing 126 and the screen assembly 128. The screen 130 of the screen assembly 128 can be formed of any structure that allows the flow of fluids through the screen 130 but not sand materials and/or other particulate materials that are larger than a certain size. The screen 130 can be a slotted pipe, a wire mesh, or any other type of structure that can perform filtering of particulate materials of greater than some predefined size.

The lower ends of the isolation tubing 126 and screen assembly 128 are sealingly engaged, such as by a three-way sub 134, or other means of sealing engagement may be provided such seals at the lower end of the isolation tubing 126 fitted into a polish bore below the screen. Below this sealing connection, hydraulic continuity is provided to the packer 102.

The portion of the sand-control tool string used for the lower zone 110 in FIG. 1 is identical to the portion of the tool string used for the upper zone 108 discussed above. The portion of the sand-control tool string for the lower zone 110 includes a circulation port assembly 140 (having sliding sleeve 143 and circulation ports 141) connected below the packer 102, and an upper three-way sub 142 connecting the circulation port assembly 140 to an isolation tubing 144 and a screen assembly 146. Also, the portion of the sand-control tool string for the lower zone 110 includes a lower three-way sub 148 that connects the isolation tubing 144 and screen assembly 146 to the packer 104.

It is noted that the view (in FIG. 1) of the tool string portion for the upper zone 108 is different from the view of the tool string portion for the lower zone 110, with the view for the portion for the upper zone 108 showing a cross-sectional view of the screen assembly 128 to illustrate the isolation tubing 126 and three-way subs 124 and 134. In contrast, the view of the tool string portion for the lower zone 110 shows a partial cross-sectional view of each of the three-way subs 142 and 148, isolation tubing 144, and screen assembly 146.

In one embodiment, the packers 100, 102, and 104, and circulation port assemblies 114 and 140 can be fracturing equipment for performing fracturing operations (in which a treatment fluid is pumped into surrounding formation to perform some treatment with respect to the formation). Treatment fluid can include fracing fluid, acid, gel, foam, or other stimulating fluid. The packers 100, 102, 104 and circulation port assemblies 114, 140 that are part of the fracturing equipment are adapted for sand-control operations by adding the isolation tubings 126, 144 and screen assemblies 128, 146 to the tool string.

Note that the specific arrangement of FIG. 1 is provided for purposes of example. In other embodiments, other arrangements of the depicted components (or alternative components) can be used.

In operation, the sand-control tool string is run into the open wellbore 106 at the end of the tubing string 112. Once the sand-control tool string is positioned at a target location downhole, the packers 100, 102, and 104 are set to isolate zones 108 and 110. In one implementation, the packers 100, 102, and 104 are set by first closing the circulation ports of the circulation port assemblies 114, 140. Then pressure can be built up in the tubing string 112 and the inner bore 120 of the sand-control tool string to allow setting of the packers 100, 102, and 104. The packers can be set by dropping a ball, shifting the packers with concentric string deployed tool, or shifting the packers with coil tubing deployed tool or through control line.

After the packers have been set, the circulation port assembly 140 for the lower zone 110 is actuated to open the circulation ports 141 of the circulation port assembly 140. This can be accomplished in one example implementation by dropping a ball (not shown) such that the ball engages the sliding sleeve 143 in the circulation port assembly 140. The ball provides a fluid seal against the sliding sleeve 143 such that an applied pressure inside the tubing string 112 and the sand-control tool string causes the sliding sleeve 143 to be moved to open the circulation ports 141. In alternative implementations, the sliding sleeve 143 (another type of valve) of the circulation port assembly 140 can be mechanically opened, such as by use of a shifting tool run inside the tubing string 112 and sand-control tool string. In yet another implementation, control lines can be run to the sand-control tool string from an earth surface location, where the control line can be a hydraulic control line, an electrical control line, or a fiber optic control line. Application of hydraulic, electrical, or optical signaling in the control line can then be used for the purpose of opening the ports 141 of the circulation port assembly 140. Another alternative technique of opening the ports 141 is by deploying a shifting tool with coil tubing.

Once the circulation ports 141 of the circulation port assembly 140 have been opened, a gravel slurry can be pumped down the tubing string 112 into the inner bore 120 of the sand-control tool string and out through the circulation ports 141 of the circulation port assembly 140 to the wellbore annulus region 150 in the lower zone 110. The gravel packing operation causes the wellbore annulus region 150 in the lower zone 110 to be filled with gravel.

Once the gravel packing of the lower zone 110 has been completed, a cleaning operation can be performed in which any sand in the tubing string 112 and sand-control tool string can be cleaned out by performing a reverse flow to the earth surface. Once the cleaning operation is completed, the circulation ports 141 of the circulation port assembly 140 are closed. Note that in embodiments in which a ball is dropped or a control line is used to activate the circulation port assemblies, as discussed above, sand control operations can be performed with respect to the plural zones without moving the sand-control tool string and without moving an inner tool inside the sand-control tool string.

Gravel packing can then be performed with respect to the upper zone 108 by opening the circulation ports 116 of the upper circulation port assembly 114 (using a similar technique to that used for the circulation port assembly 140 for the lower zone 110). A gravel slurry can then be pumped down the tubing string 112 and flowed out through the circulation ports 116 into the wellbore annulus region 122 (as indicated by the arrows, shown in FIG. 1). Once the gravel packing of the wellbore annulus region 122 in the upper zone 108 has been completed, a cleaning operation is performed, after which the circulation ports 116 are closed.

In the embodiment of FIG. 1, the isolation tubings 126 and 144 are then punctured to allow production of hydrocarbons from formations 112, 114 through the screens 130, 141 into the sand-control tool string. The puncturing can be performed by using an explosive device or a cutter tool or run inside the tubing string 112 and sand-control tool string. The puncturing creates openings in the isolation tubings. The hydrocarbons are produced upwardly through the sand-control tool string through the tubing string 112 to the earth surface. In an alternative embodiment, instead of having to puncture the isolation tubings 126 and 144, the isolation tubings can be provided with production ports and associated valves (such as sliding sleeves), which can be actuated to the open position to allow hydrocarbons to flow into the inner bore of the sand-control tool string.

Figure 2:
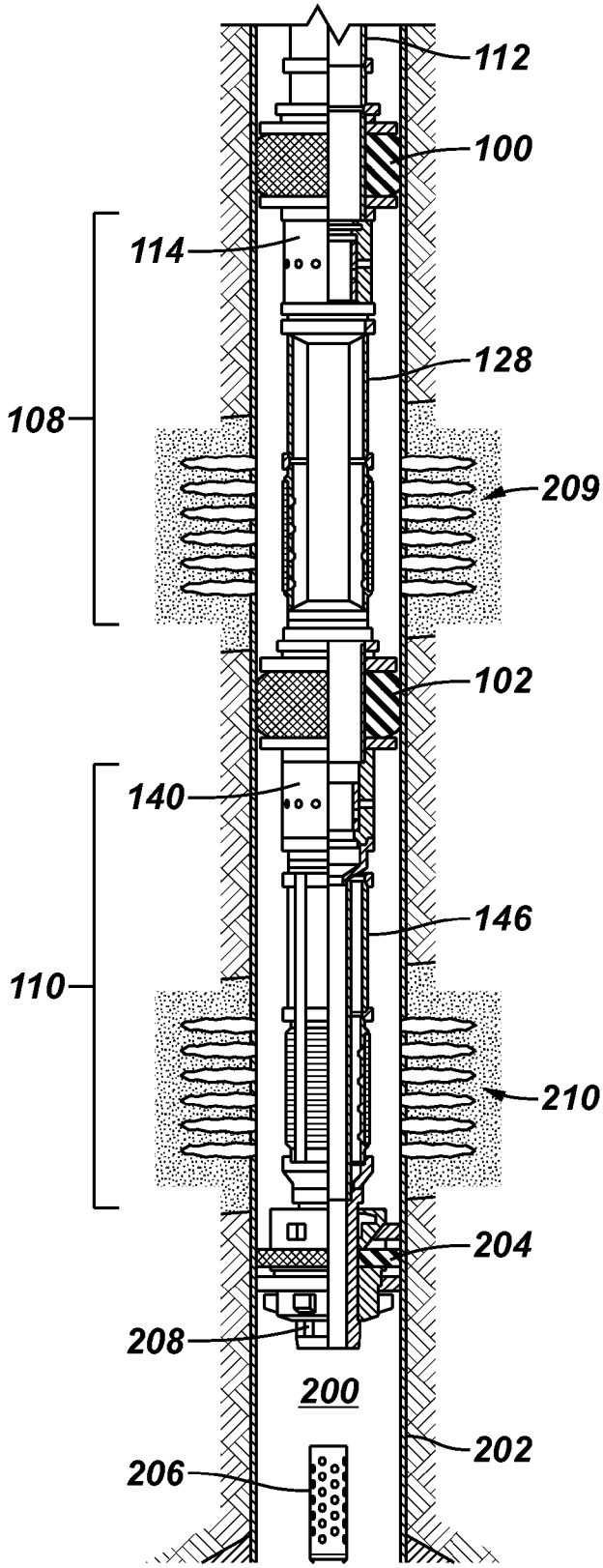
FIG. 2 illustrates a sand-control tool string for use in a cased wellbore, according to another embodiment.

As noted above, FIG. 1 shows a sand-control tool string used in an open wellbore 106. In an alternative embodiment, a modified version of the sand-control tool string can be used with a cased wellbore, such as cased wellbore 200 in FIG. 2. The cased wellbore 200 is lined with casing 202. The sand-control tool string of FIG. 2 can also be attached to the tubing string 112. The sand-control tool string of FIG. 2 shares most of the same components as the sand-control tool string of FIG. 1 (which common components are assigned the same reference numerals). The sand-control tool string of FIG. 2 differs from the sand-control tool string of FIG. 1 in that the lowermost packer 104 of the sand-control tool string of FIG. 1 is replaced with a perforation packer 204 in the sand-control tool string shown in FIG. 2. A perforating gun string 206 is connected below the perforation packer 204. FIG. 2 shows the perforating gun string 206 in a released state in which the perforating gun string 206 has been released from the perforation packer 204. Initially, however, the perforating gun string 206 is connected to the perforation packer 204.

In operation, the sand-control tool string of FIG. 2 is run into the cased wellbore 200 to a position in which the perforating gun string 206 is positioned adjacent zones 108 and 110. This first position of the sand-control tool string is the perforating position. The perforating gun string 206 is activated (such as by using tubing pressure, mechanical force, a hydraulic control line, an electrical control line, or a fiber optic control line). The perforating gun string 206, when activated, fires perforating jets through the casing 202 to form perforations 209 in the upper zone 108 and perforations 210 in the lower zone 110. The perforation packer 204 can be provided with a quick-release mechanism 208 that allows the perforating gun string 206 to be disconnected from the perforation packer 204 to allow the perforating gun string 206 to drop to the bottom of the wellbore 200. The perforating gun string 206 can be automatically released by the quick-release mechanism 208 upon firing of the perforating gun string 206. Alternatively, the quick-release mechanism 208 can be actuated by tubing pressure, mechanical force, hydraulic control, electrical control, or fiber optic control.

After perforating, the wellbore 200 is killed (by filling the wellbore with a heavy fluid or by activating an isolation valve, for example), and the perforation packer 204 is unset. This allows the sand-control tool string of FIG. 2 to be moved to a gravel-pack position (by lowering the tool string further into the wellbore 206). In the gravel pack position, the packers 100, 102, 204 straddle the zones 108, 110 as previously described.

After the sand-control tool string has been moved to the gravel-pack position, the gravel-packing operation performed by the sand-control tool string of FIG. 2 is identical to the operation described with respect to the sand-control tool string of FIG. 1.

Figure 3:
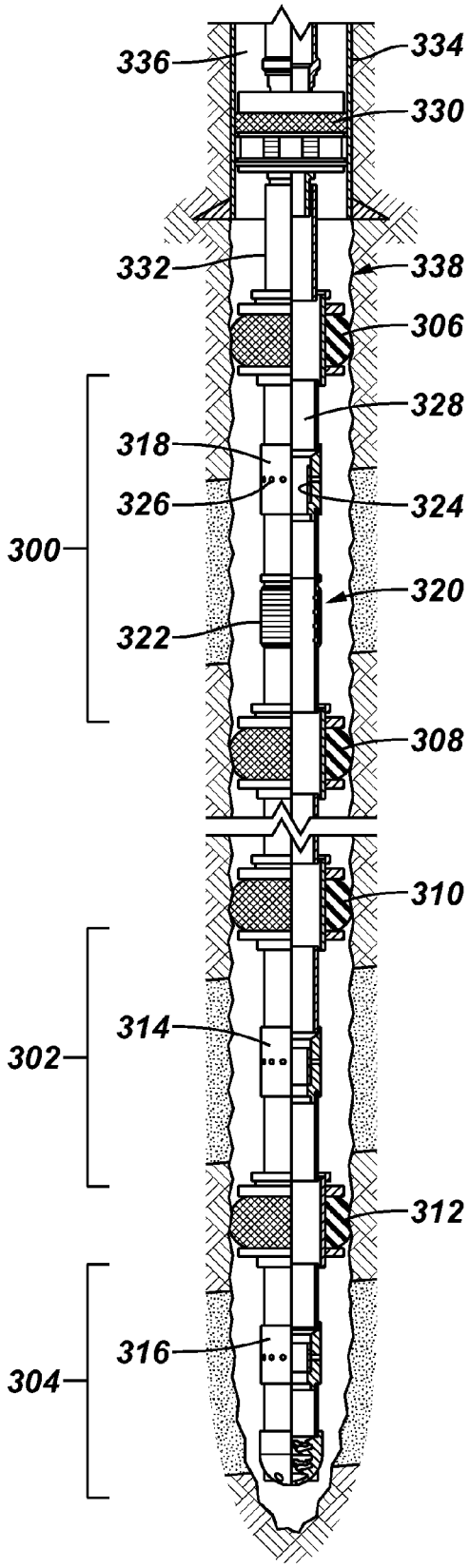
FIG. 3 illustrates a sand-control tool string according to yet another embodiment.

FIG. 3 shows an alternative tool string that can be used. In the example of FIG. 3, three zones 300, 302, and 304 are defined using packer 306, 308, 310 and 312. In the arrangement of FIG. 3, no sand control is performed with respect to zones 302 and 304. Consequently, the portions of the tool string in zones 302 and 304 do not contain sand control assembles. In each of zones 302 and 304, the tool string of the FIG. 3 includes a respective circulation port assembly 314, 316 (which can be used for fracturing or stimulating operations, as examples).

The portion of the tool string in zone 300 includes a circulation port assembly 318 and a sand control assembly 320 that has a sand-control string 322. Note that the arrangement of the circulation port assembly 318 and sand control assembly 320 is different from the arrangement depicted in FIG. 1 or FIG. 2. In FIG. 3, an isolation tubing is not used inside the sand control assembly 320.

The circulation port assembly has a sliding sleeve 324 with a filter layer for controlling flow of fluids through circulation ports 326. By way of example, the filter layer could be a wire wrap or mesh or wool or any media to prevent sand production. The wire-wrapped sliding sleeve 324 is a regular sliding sleeve that has been wrapped with wire to prevent sand from entering the inner bore 328 of the tool string.

The tool string further has a production packer 330 connected above the packer 306 by a tubing segment 332. Note that the production packer 330 is set against casing 334 in a cased portion 336 of the wellbore. The portion of the tool string below the production packer 330 is located in an open wellbore segment 338 that is not lined with casing or liner.

Although only one zone 300 is depicted as requiring sand control, it is noted that the assembly of the tool string inside zone 300 can be repeated for another zone for performing sand control in the other zone. In such other configuration, selective activation of respective circulation port assemblies can be performed to perform selective sand control with respect to the multiple zones.

Figure 4:
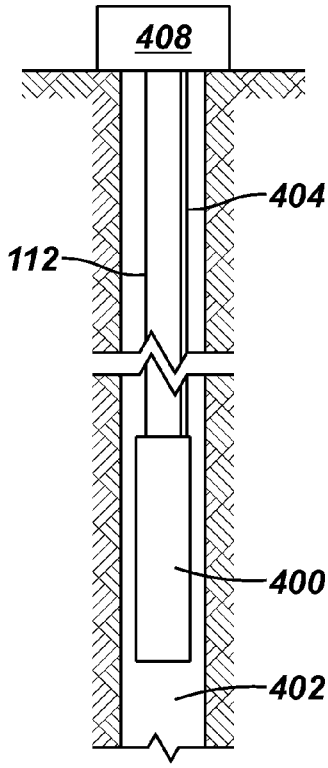
FIG. 4 illustrates an example string that incorporates a sand control tool string according to any one of FIGS. 1-3.

FIG. 4 shows a sand-control tool string 400 (which can be the tool string of any one of FIGS. 1-3), carried on a tubing string 112, positioned inside a wellbore 402 (which can be either open wellbore 106, 338 or cased wellbore 206). The tubing string 112 extends from wellhead equipment 114, located at earth surface 116. The earth surface 116 can be land, or alternatively, the earth surface 116 can be a sea floor in a subsea well context.

FIG. 4 further shows a control line 404 extending from the wellhead equipment 114 to the sand-control tool string 400. The control line 404 can be a hydraulic control line, an electrical control line, or a fiber optic control line (or some combination of the above) used for controlling circulation port assemblies (114, 140), setting packers, activating perforating guns, and/or activating a quick-release mechanism.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method of performing sand-control in a wellbore, the method comprising:

forming a sand-control tool string comprising multiple pairs of flow port assemblies and screen assemblies, and multiple packers that are settable to define different zones in a wellbore;

using a rig comprising a drill string to run the sand-control tool string into the wellbore;

attaching a tubing string to an end of the sand-control tool string;

after the sand-control tool string has been run into the wellbore, setting the packers to define the different zones in the wellbore with a first flow port assembly and first sand screen assembly in a first zone and a second flow port assembly and second sand screen assembly in a second zone;

moving the rig from the wellsite after setting the packers;

after moving the rig, remotely selectively activating the flow port assemblies riglessly without the presence of the rig at the wellsite to perform selective gravel packing with respect to the first zone and the second zone, wherein the gravel packing with respect to the plural zones after setting the packers is performed without the presence of the rig at the wellsite and without moving the first flow port assembly and first screen assembly from the first zone to the second zone and without moving the second flow port assembly and second screen assembly from the second zone to the first zone, and wherein performing gravel packing with respect to the first zone and the second zone includes flowing a gravel slurry from the earth surface of the wellbore through the tubing string and to the corresponding zone through the corresponding activated flow port assembly.

2. The method of claim 1, wherein the gravel packing with respect to the plural zones is performed without deploying a separate tool inside the sand-control tool string for controlling the flow port assemblies.

3. The method of claim 1, wherein at least one of the flow port assemblies comprises a sliding sleeve with a filter layer for controlling flow of fluids through the flow port assembly.

4. The method of claim 1, wherein the remotely selectively activating the flow port assemblies is performed with a control line connected to the flow port assemblies to control opening and closing of flow ports of corresponding flow port assemblies.

5. The method of claim 1, wherein selectively activating the flow port assemblies comprises:

activating a first one of the flow port assemblies to open flow ports in the first flow port assembly to enable communication of gravel slurry to a well annulus in a first one of the plural zones;

closing the first flow port assembly; and activating a second one of the flow port assemblies to open flow ports in the second flow port assembly to enable communication of gravel slurry to a well annulus in a second one of the plural zones.

6. The method of claim 1, further comprising after the plural zones have been gravel packed, puncturing an isolation tubing adjacent respective screen assemblies to allow production of fluids from adjacent formations into an inner bore of the sand-control tool string.

7. A method of performing sand-control in a wellbore, the method comprising:

using a rig comprising a drill string to run a sand-control tool string into the wellbore, wherein the sand-control tool string comprises a flow port assembly and a packer;

attaching a tubing string to an end of the sand-control tool string;

after the sand-control tool string has been run into the wellbore, setting a packer to define a zone in the wellbore;

moving the rig from the wellsite after setting the packers;

after moving the rig, performing gravel packing with respect to the zone without the presence of the rig at the wellsite comprising remotely activating the flow port assembly riglessly and flowing a gravel slurry from the earth surface of the wellbore through the tubing string and to the corresponding zone through the corresponding activated flow port assembly.

8. The method of claim 7, wherein the gravel packing is performed without deploying a separate tool inside the sand-control tool string for controlling the flow port assembly.

9. The method of claim 7, wherein the flow port assemblies comprises a sliding sleeve with a filter layer for controlling flow of fluids through the flow port assembly.

10. The method of claim 7, further comprising after the zone has been gravel packed, puncturing an isolation tubing adjacent a screen assembly to allow production of fluids from adjacent formations into an inner bore of the sand-control tool string.

11. A method of performing sand-control in a wellbore, the method comprising:

using a rig to run a sand-control tool string into the wellbore at the end of a tubing string, wherein the sand-control tool string comprises multiple pairs of flow port assemblies and screen assemblies, and multiple packers that are settable to define different zones in a wellbore;

after the sand-control tool string has been run into the wellbore, setting the packers to define the different zones in the wellbore with a first flow port assembly and first sand screen assembly in a first zone and a second flow port assembly and second sand screen assembly in a second zone;

moving the rig from the wellsite after setting the packers;

after moving the rig, performing a sand-control operation with respect to the first zone and the second zone without the presence of the rig at the wellsite comprising activating the flow port assemblies riglessly and flowing a fluid through the tubing string and to the corresponding zone through the corresponding activated flow port assembly.

12. The method of claim 11, wherein the flowing a fluid to a corresponding zone comprises flowing a gravel slurry.

13. The method of claim 11, wherein the flow port assemblies comprises a sliding sleeve with a filter layer for controlling flow of fluids through the flow port assembly.

14. The method of claim 11, further comprising after the zone has been gravel packed, puncturing an isolation tubing adjacent a screen assembly to allow production of fluids from adjacent formations into an inner bore of the sand-control tool string.

15. The method of claim 11, wherein the flow port assemblies each have a sliding sleeve to be actuated by dropping a ball to engage the sliding sleeve to provide a fluid seal against the sliding sleeve and applying fluid pressure to move the sliding sleeve and actuate the flow port assembly.

16. The method of claim 11, wherein the remotely selectively activating the flow port assemblies is performed with a control line connected to the flow port assemblies to control opening and closing of flow ports of corresponding flow port assemblies.

17. The method of claim 11, wherein selectively activating the flow port assemblies comprises:

activating a first one of the flow port assemblies to open flow ports in the first flow port assembly to enable communication of gravel slurry to a well annulus in a first one of the plural zones;

closing the first flow port assembly; and activating a second one of the flow port assemblies to open flow ports in the second flow port assembly to enable communication of gravel slurry to a well annulus in a second one of the plural zones.

18. The method of claim 11, wherein the remotely selectively activating the flow port assemblies is performed by deploying a shifting tool to open and close flow ports of corresponding flow port assemblies.

* * * * *